United States Patent [19]

Johnson

[11] Patent Number: 4,708,636

[45] Date of Patent: Nov. 24, 1987

[54] FLOW SENSOR FURNACE CONTROL

[75] Inventor: Robert G. Johnson, Minnetonka, Minn.

[73] Assignee: Honeywell Inc., Minneapolis, Minn.

[21] Appl. No.: 786,188

[22] Filed: Oct. 10, 1985

Related U.S. Application Data

[63] Continuation of Ser. No. 511,826, Jul. 8, 1983, abandoned.

[51] Int. Cl.[4] ..... F23N 3/00

[52] U.S. Cl. ..... 431/20; 431/12; 236/15 C; 236/15 B D

[58] Field of Search ..... 431/12, 18, 19, 20, 431/75, 84, 90; 126/285 B, 110 R; 236/15 C, 15 B D, 25 R, 25 A

[56] References Cited

U.S. PATENT DOCUMENTS

| | | | |
|---|---|---|---|
| 1,721,800 | 7/1929 | Wünsch . | |
| 1,914,949 | 6/1933 | Hardgrove . | |
| 2,026,197 | 12/1935 | Stoker . | |
| 2,030,386 | 2/1936 | Miller . | |
| 2,127,445 | 8/1938 | Hardgrove . | |
| 2,228,769 | 1/1941 | Klinker . | |
| 2,269,705 | 1/1942 | Besler . | |
| 2,538,222 | 1/1951 | Wilson . | |
| 2,704,571 | 3/1955 | Reichelderfer . | |
| 2,723,558 | 11/1955 | Germer . | |
| 2,822,865 | 2/1958 | Hudson . | |
| 3,106,239 | 10/1963 | Jansen et al. . | |
| 3,431,056 | 3/1969 | Winegardner . | |
| 3,768,956 | 10/1973 | Mueller et al. . | |
| 3,992,598 | 11/1976 | Welsh et al. . | |
| 4,125,093 | 11/1978 | Platzer, Jr. | 431/90 |
| 4,189,296 | 2/1980 | Hayes . | |
| 4,204,833 | 5/1980 | Kmetz et al. . | |
| 4,239,477 | 12/1980 | Hayes . | |
| 4,241,874 | 12/1980 | Schossow . | |
| 4,251,025 | 2/1981 | Bonne et al. . | |
| 4,329,138 | 5/1982 | Riordan . | |
| 4,334,855 | 6/1982 | Nelson . | |
| 4,340,355 | 7/1982 | Nelson et al. | 431/20 |
| 4,373,897 | 2/1983 | Torborg | 236/15 C |
| 4,425,930 | 1/1984 | Kruto | 431/12 |

*Primary Examiner*—Samuel Scott
*Assistant Examiner*—H. A. Odar
*Attorney, Agent, or Firm*—Charles G. Mersereau

[57] ABSTRACT

Disclosed is a heating system having a combustion air blower, a fuel valve for providing fuel to a burner, and an exhaust stack for exhausting combustion products. Also disclosed is flow sensor apparatus operatively associated with the stack for providing control signals to a furnace control, the control signals being related to flow conditions in the stack.

27 Claims, 2 Drawing Figures

FLOW SENSOR FURNACE CONTROL

This is a continuation of application Ser. No. 511,826, filed July 8, 1983, now abandoned.

BACKGROUND OF THE INVENTION

The present invention relates to the control of a furnace with a flow sensor.

In heating systems comprising a combustion air blower and a fuel valve for providing fuel to a burner, it is generally desired to provide fuel to the burner only when proper conditions exist for flame and to maintain an optimum fuel-to-air ratio when the burner is in operation. Prior art approaches to these problems are relatively complex. Accordingly, the present invention was developed for providing control of a fuel valve in a heating system or other appliance.

Systems incorporating the present invention are typically simplified over prior art systems and may incorporate one or more of three separate and distinct features: (1) the present invention may be incorporated to allow fuel to flow only upon sensing a predetermined minimum air flow; (2) the present invention may be incorporated to modulate the fuel flow so that a fixed fuel-to-air ratio is maintained; and (3) the present invention may be incorporated to shut off fuel completely if air flow substantially ceases, such as in the case of a blocked stack or malfunctioning combustion blower. While some or all of these features are available in prior art systems, these prior art typical systems are far more complex than typical systems incorporating the present invention.

SUMMARY OF THE INVENTION

The present invention relates to a heating system having a combustion air blower, a fuel valve for providing fuel to a burner and an exhaust stack for exhausting combustion products. The invention is an improvement comprising a flow sensor operatively associated with the stack for providing control signals to a furnace control, the control signals being related to flow conditions in the stack.

DESCRIPTION OF THE PREFERRED EMBODIMENTS

U.S. Pat. No. 4,251,025 provides a very complete description of how a furnace control system functions generally. That patent is incorporated by reference in the present application as if fully set forth herein.

Figure 1:
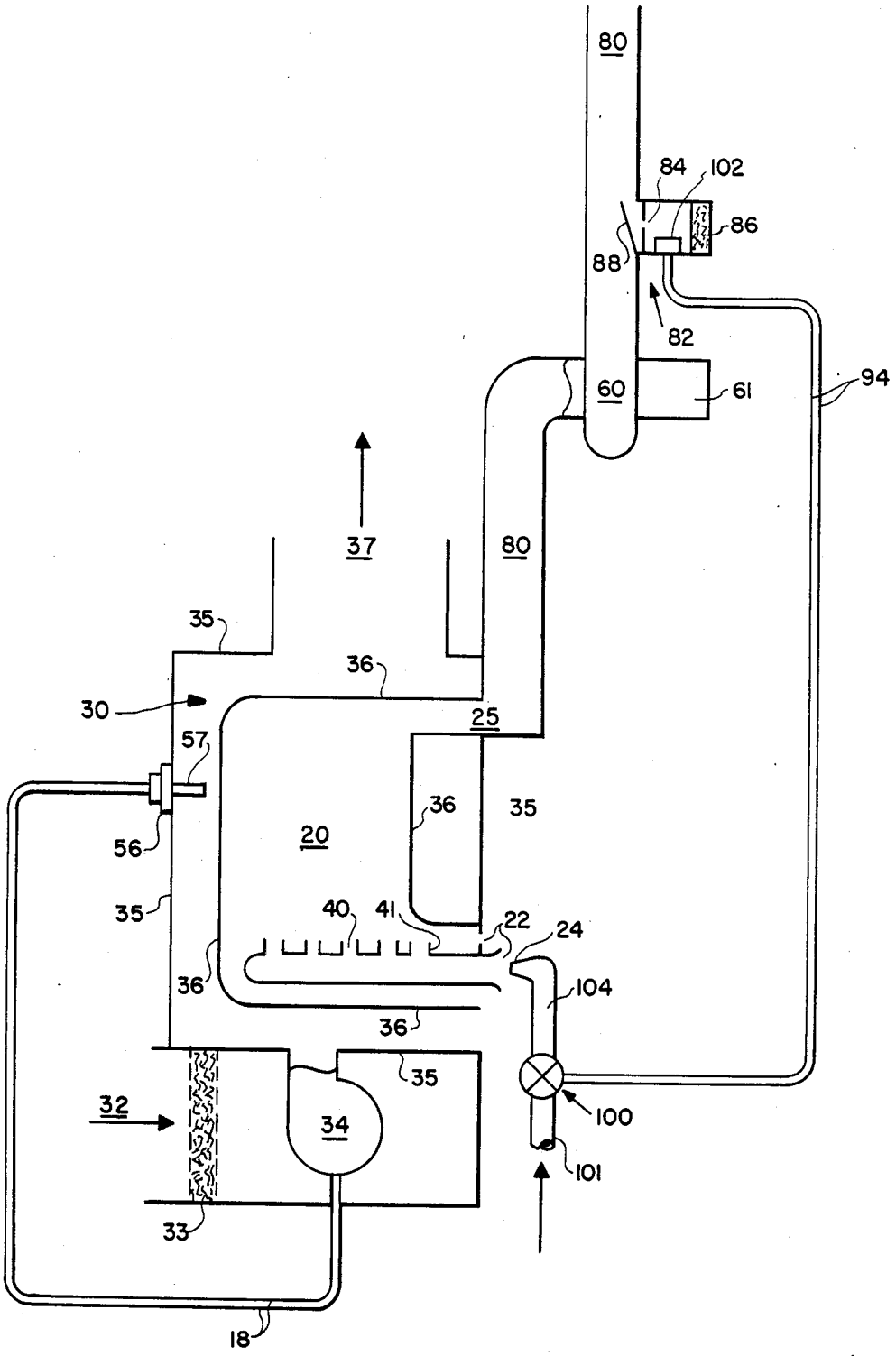
FIGS. 1 and 1A schematically illustrate alternate preferred embodiments of a heating system incorporating the present invention.

FIG. 1 illustrates an induced draft furnace incorporating a preferred embodiment of the present invention. Although the present invention is not limited to induced draft furnaces, it will be explained here in connection with such a heating system.

The heating system shown in FIG. 1 comprises a combustion chamber 20 which has a burner 40 located near its bottom and which is substantially enclosed by exterior walls 36. Fuel, which in the preferred embodiment is a gas such as natural gas or liquified petroleum, is fed to burner 40 by a gas outlet 24 near the mouth of burner 40. Air enters burner 40 and combustion chamber 20 at air inlets 22 located near the tip of gas outlet 24 and the mouth of burner 40. Burner 40 is ignited by a pilot, not shown.

Surrounding combustion chamber 20 is a heat exchanger 30 with its interior boundary being formed by exterior walls 36 of combustion chamber 20, the exterior boundary of heat exchanger 30 being formed by walls 35. Thus, two separate fluid paths are formed. The combustion chamber path leads from gas outlet 24 and air inlets 22 through burner 40 and out of a flue 25. The heat exchanger path follows the exterior walls 36 of combustion chamber 20; the fluid to be heated enters below burner 40 and proceeds along a vertical portion of the enclosed area between walls 34 and the exterior burner wall 36 to exit above combustion chamber 20. While in the embodiment shown air is the fluid to be heated, other fluids such as water may be used with minor design changes.

Movement of air into and through heat exchanger 30 is provided by a fan 34 driven by an electric motor. Cold air is pulled into heat exchanger 30 at a cold air return duct 32 and passes through an air filter 33 before it enters fan 34. Fan 34 drives the air into heat exchanger 30 through an opening in its bottom wall. Heated air passes out of heat exchanger 30 through a warm air duct 37 which extends from an opening in a top wall in heat exchanger 30.

With the exception of flue 25 and combustion air inlets 22, combustion chamber 20 is enclosed and substantially air tight. Accordingly, the only exit for combustion material is provided by flue 25. In order to induce air to enter combustion chamber at bottom air inlets 22 and to induce combusted gases to exit from combustion chamber 20 and flow out of flue 25 in exhaust stack or vent 80, an induced draft blower 60 is used. This induced draft blower (which is powered by an electric motor 61) is located in line with flue 25 and exhaust stack or vent 80. Blower 60 may be single or multiple speed, depending upon the type of control system with which it is to be used.

A fluid, preferably natural gas or liquified petroleum, is provided to burner 40 at gas outlet 24 which is fed by an outlet pipe 104 of a fuel valve 100. Gas from a supply line at line pressure enters gas valve 100 at a gas inlet pipe 101. Gas valve 100 may comprise a standard electrically actuated on-off valve as well as means for modulating the gas flow rate of fuel supplied to burner 40.

By way of further describing operation of the heating system illustrated in FIG. 1, fan 34 is electrically connected via wires 18 to a fan limit control switch 56 which is driven by a temperature sensitive element 57 such as a bimetal thermostat. This temperature sensitive element 57 causes fan 34 to be switched on when the air temperature in heat exchanger 30 rises above a predetermined temperature (fan start set point) and to be switched off when the temperature of the air is heat exchanger 30 falls below a predetermined temperature (fan stop set point). To minimize condensation in heat exchanger 30, the fan start set point is chosen substantially at or somewhat above the dew point. One suitable temperature sensitive switch for this purpose is the L4064 fan and limit switch manufactured by Honeywell Inc. of Minneapolis, Minn.

Because one purpose of fan limit control switch 56 is to delay fan start up until heat exchanger 30 contains air at or above the dew point, a time delay mechanism may be substituted for temperature sensitive element 57. This mechanism may be activated at the same time as blower motor 61, but it would delay fan start up for a predetermined period sufficient to let heat exchanger 30 reach the dew point temperature.

Gas inlet pipe 101 may comprise a manually-actuated on-off valve (not shown) between inlet 101 and the supply of fuel. Such a manually-actuated valve may be used to manually activate or deactivate valve 100. In such a case, opening of the manually actuated valve would be a prerequisite to any flow of gas from outlet pipe 104 or valve 100. Other "redundant" closure points may also be employed in order to provide additional conditions which must be met before valve 100 permits gas to flow to burner 40. However, such manually-actuated valves or other redundant closure points are not necessary to the present invention.

The improvement of the present invention comprises flow sensor apparatus 102 operatively associated with exhaust stack 80 for providing control signals to a furnace control, the control signals being related to flow conditions in the stack. In the preferred embodiment of the present invention, flow sensor apparatus 102 comprises a flow sensor 102, and the furnace control (to which flow sensor 102 provides control signals) comprises valve 100.

In the system disclosed, stack 80 comprises apparatus 82 upstream of blower 60 permitting air flow sensing between the interior of stack 80 and ambient pressure outside the stack. In the embodiment of FIG. 1, apparatus 82 comprises flow sensor 102, an orifice 84 connecting the interior of stack 80 and ambient air pressur outside the stack, and an optional filter 86, preferably of lower impedance, to help prevent dust and lint from reaching the flow sensor.

Flow sensor 102 is typically placed next to orifice 84 for sensing the air flow through orifice 84.

The primary purpose of orifice 84 is to prevent too large a flow from entering stack 80 from the exterior of stack 80.

An optional deflector 88 may be incorporated within stack 80 for enhancing the flow from the exterior of stack 80 into the interior of stack 80 by creating an aspiration effect at the top of the deflector. Without such a deflector turbulence effects may create intermittent back flow conditions causing flow sensor 102 to detect an intermittent flow going from the interior of stack 80 to the exterior. In addition deflector 88 causes the detectable flow going into stack 80 to be higher than would normally be the case under Poiseuille's law with flow going up stack 80 without deflector 88 in place.

Figure 1A:
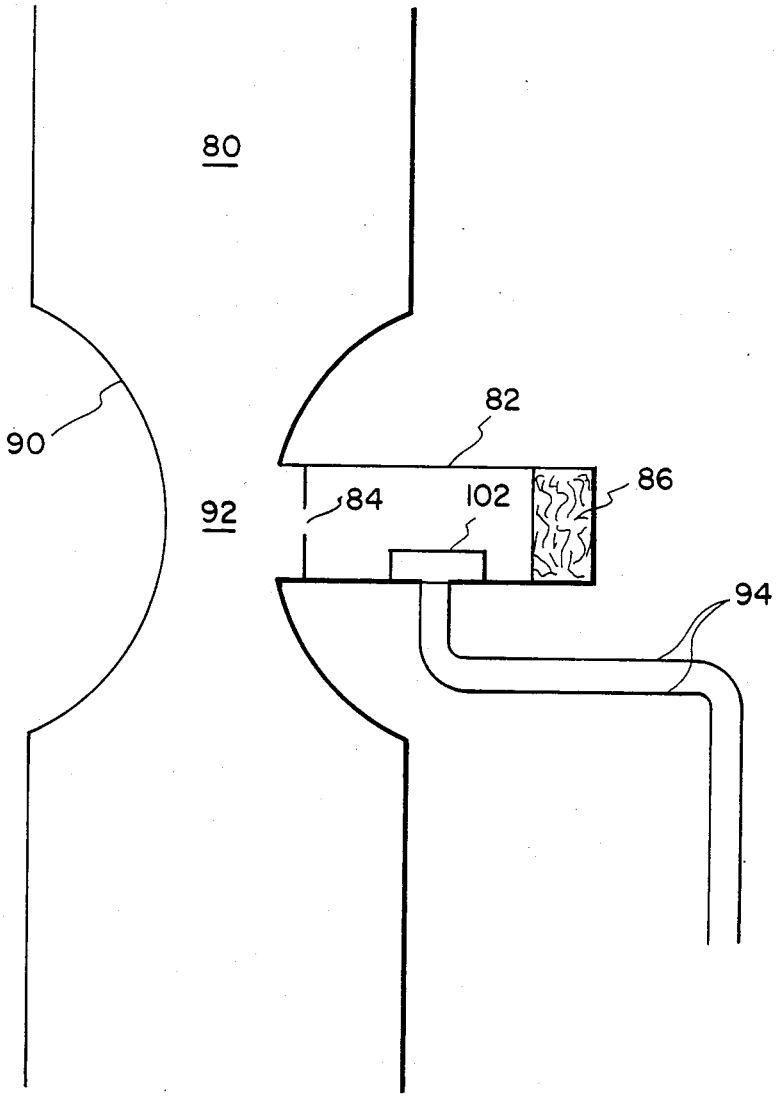

An alternate means for enhancing the flow through stack 80 and accordingly through orifice 84 is illustrated in FIG. 1A. In that embodiment, stack 80 comprises a venturi 90 adapted to receive apparatus 82 at nozzle 92 of venturi 90. Air flow through nozzle 92 and accordingly into stack 80 through orifice 84 will be higher at nozzle 92 of venturi 90 than if orifice 84 is simply located in the side of a normal stack 80.

Although the plate comprising orifice 84 is shown set back from the wall of stack 80 in FIG. 1 and from the wall of venturi nozzle 92 in FIG. 1A, the orifice could be placed directly into the wall of these devices as opposed to placing orifice 84 in the plates as illustrated.

In operation of the heating system when blower 60 impells air and combustion gasses up stack 80 the pressure in the moving air within stack 80 under proper operating conditions is less than the still air outside of stack 80. Consequently, in accordance with the present invention, any small orifice such as 84 in the wall of stack 80 will experience an air flow from outside the stack into the stack. As previously indicated, this flow can be enhanced as desired by producing an aspiration effect through the placement of deflector 88 over the inner side of orifice 84 or by incorporating a venturi 90 within stack 80 and placing orifice 84 in or near the wall of venturi nozzle 92. Air flow sensor 102 is placed next to orifice 84 in order to sense flow through it and in order to provide control signals over wires 94 to a furnace control such as valve 100, the control signals being related to flow conditions in the stack.

In the operation of burner 40 a failure of blower 60 eliminates or greatly reduces the pressure drop across orifice 84 (as well as the flow into stack 80 from outside the stack), and the lack of flow or reduced flow through orifice 84 causes resulting control signals from flow sensor 102 to close valve 100. If a blocked stack occurs the pressure build up within stack 80 greatly reduces the differential pressure across orifice 84, and the flow rate from outside stack 80 into stack 80 through orifice 84 is greatly reduced or is even caused to occur in the opposite direction, again triggering a shutdown of the system through closure of valve 100. Thus, any failure of flow sensor 102 to output the proper flow or control signals results in a fail safe shutdown of the system.

While flow sensor 102 may comprise any high sensitivity flow sensor which can measure flow direction as well as flow rate, alternate preferred embodiments of the preferred flow sensor for the present invention are described in patent application Ser. No. 431,538, filed Sept. 30, 1982, now U.S. Pat. No. 4,478,077, which is incorporated by reference herein as if fully set forth in the present application.

The present invention is to be limited only in accordance with the scope of the appended claims since persons skilled in the art may devise other embodiments still within the limits of the claims.

The embodiments of the invention in which an exclusive property or right is claimed are defined as follows:

1. In a heating system having a combustion chamber with a fuel burner, an induced draft air blower, a control system including an electrically controlled fuel valve for controlling a supply of fuel to the burner, and an exhaust stack for exhausting combustion products, the improvement comprising:

means enabling a dynamic flow between the interior of the exhaust stack and the external ambient atmosphere including a flowmeter housing connected between an opening provided in the wall of the exhaust stack and the external ambient atmosphere, said housing having a single internal chamber having a first opening connected to the opening in the wall of the exhaust stack and having a second opening connected to the external ambient atmosphere;

an electronic flowmeter disposed in said single internal chamber for directly sensing the rate and direction of flow through the chamber and producing electrical output signals indicative thereof;

means connecting said electronic flowmeter output signals with said fuel valve, wherein said signals are used to control said fuel valve when predetermined conditions are indicated.

2. The apparatus of claim 1 further comprising means disposed in said exhaust stack and fixed in spaced relation to said opening in the wall of said exhaust stack to dynamically cause a reduction in the static internal stack pressure at said opening.

3. The apparatus of claim 2 wherein said means for reducing the internal stack pressure is a venturi.

4. The apparatus of claim 2 wherein said means for reducing the internal stack pressure is a deflector member fixed in angular spaced relation to said opening.

5. The apparatus of claim 1 wherein the fuel valve comprises means for permitting fuel flow to the burner under predetermined flow conditions sensed by the flow sensor and for prohibiting fuel flow to the burner under other predetermined flow conditions responsive to said output signals produced by the flow sensor.

6. The apparatus of claim 5 wherein fuel flow to the burner is prohibited when said output signals indicate a condition of abnormally low inward flow or flow outward from said stack.

7. The apparatus of claim 1 wherein the fuel valve comprises means for modulating the flow rate of fuel to the burner is response to said output signals when said output signals are indicatve of a flow rate sensed by the flow sensor within a predetermined range.

8. In a heating system having a combustion chamber with a fuel burner, an induced air blower, a control system including an electrically controlled fuel valve for controlling a supply of fuel to the burner, and an exhaust stack for exhausting combustion products, the improvement comprising:

means enabling a dynamic flow between the interior of the exhaust stack and the external ambient atmosphere including a flowmeter housing connected between an opening provided in the wall of the exhaust stack and the external ambient atmosphere, said housing having a single internal chamber having a first opening connected to the opening in the wall of the exhaust stack and having a second opening connected to the external ambient atmosphere;

an electronic flowmeter disposed in said single internal chamber for directly sensing the rate and direction of flow through the chamber and producing electrical output signals indicative thereof;

conductor means connecting said electronic flowmeter output signals with said fuel valve, wherein said signals are used to control said fuel valve when predetermined conditions are indicated; and means disposed in said exhaust stack and fixed in spaced relation to said opening in the wall of said exhaust stack to dynamically reduce the static internal stack pressure at said opening.

9. The apparatus of claim 8 wherein said means for reducing the internal stack pressure is a venturi.

10. The apparatus of claim 8 wherein said means for reducing the internal stack pressure is a flow deflector plate member fixed in angular spaced relation to said opening.

11. The apparatus of claim 8 wherein the fuel valve comprises means for permitting fuel flow to the burner under predetermined flow conditions sensed by the flow sensor and for prohibiting fuel to the burner under other predetermined flow conditions responsive to said output signals produced by the flow sensor.

12. The apparatus of claim 8 wherein the fuel valve comprises means for modulating the flow rate of fuel to the burner responsive to flowmeter output signals indicative of the flow rate sensed by the flow sensor within a predetermined range.

13. The apparatus of claim 11 wherein fuel flow to the burner is prohibited responsive to flowmeter output signals indicating a low flow condition or flow outward from said stack.

14. The apparatus of claim 6 comprising means for preventing intermittent backflow conditions from causing the flow sensor to indicate flow from the stack interior to the stack exterior due to momentary turbulence effects in the stack.

15. The apparatus of claim 13 comprising means for preventing intermittent backflow conditions from causing the flow sensor to indicate flow from the stack interior to the stack exterior due to momentary turbulence effects in the stack.

16. In a heating system having a combustion chamber with a fuel burner, an induced draft air blower, a control system including an electrically controlled fuel valve for controlling a supply of fuel to the burner, and an exhaust stack for exhausting combustion products, the improvement comprising:

means enabling a dynamic flow between the interior of the exhaust stack and the external ambient atmosphere including a flowmeter housing connected between an opening provided in the wall of the exhaust stack and the external ambient atmosphere, said housing having a single internal chamber having a first opening connected to the opening in the wall of the exhaust stack and having a second opening connected to the external ambient atmosphere;

an electronic flowmeter disposed in said chamber for directly sensing the rate and direction of flow through said chamber and producing electrical output signals indicative thereof, said flowmeter comprising:

a thin film heater suspended in air; and a pair of thin film heat sensors suspended in air and disposed on opposite sides of the heater; and means connecting said electronic flowmeter output signals with said fuel valve, wherein said signals are used to control said fuel valve when predetermined conditions are indicated.

17. The apparatus of claim 16 further comprising means disposed in said exhaust stack and fixed in spaced relation to said opening in the wall of said exhaust stack to dynamically cause a reduction in the static internal stack pressure at said opening.

18. The apparatus of claim 17 wherein said means for reducing the internal stack pressure is a venturi.

19. The apparatus of claim 17 wherein said means for reducing the internal stack pressure is a deflector member fixed in angular spaced relation to said opening.

20. The apparatus of claim 16 wherein the fuel valve comprises means for permitting the fuel flow to the burner under predetermined flow conditions sensed by the flow sensor and for prohibiting fuel flow to the burner under other predetermined flow conditions responsive to said output signals produced by the flow sensor.

21. The apparatus of claim 16 wherein the fuel valve comprises means for modulating the flow rate of fuel to the burner in response to said output signals when said output signals are indicative of a flow rate sensed by the flow sensor within a predetermined range.

22. In a heating system having a combustion chamber with a fuel burner, an induced air blower, a control system including an electrically controlled fuel valve for controlling a supply of fuel to the burner, and an exhaust stack for exhausting combustion products, the improvement comprising:

means enabling a dynamic flow between the interior of the exhaust stack and the external ambient atmosphere including a flowmeter housing connected between an opening provided in the wall of the exhaust stack and the external ambient atmosphere, said housing having a single internal chamber having a first opening connected to the opening in the wall of the exhaust stack and having a second opening connected to the external ambient atmosphere;

an electronic flowmeter disposed in said chamber for directly sensing the rate and direction of flow through said chamber and producing electrical output signals indicative thereof, said flowmeter comprising: a thin film heater suspended in air; and a pair of thin film heat sensors suspended in air and disposed on opposite sides of the heater;

conductor means connecting said electronic flowmeter output signals with said fuel valve, wherein said signals are used to control said fuel valve when predetermined conditions are indicated; and means disposed in said exhaust stack and fixed in spaced relation to said opening in the wall of said exhaust stack to dynamically reduce the static internal stack pressure at said opening.

23. The apparatus of claim 22 wherein said means for reducing the internal stack pressure is a venturi.

24. The apparatus of claim 22 wherein said means for reducing the internal stack pressure is a flow deflector plate member fixed in angular spaced relation to said opening.

25. The apparatus of claim 22 wherein the fuel valve comprises means for permitting fuel flow to the burner under predetermined flow conditions sensed by the flow sensor and for prohibiting fuel flow to the burner under other predetermined flow conditions responsive to said output signals produced by the flow sensor.

26. The apparatus of claim 22 wherein the fuel valve comprises means for modulating the flow rate of fuel to the burner responsive to flowmeter output signals indicative of the flow rate sensed by the flow sensor within a predetermined range.

27. The apparatus of claim 26 wherein fuel flow to the burner is prohibited responsive to flowmeter output signals indicating a low flow condition or flow outward from said stack.

* * * * *